US005520523A

United States Patent [19]

Yorita et al.

[11] Patent Number: 5,520,523

[45] Date of Patent: May 28, 1996

[54] DIAPHRAGM-TYPE PUMP

[75] Inventors: Hiroshi Yorita, Kariya; Kou Ohtsuka; Kazuhide Watanabe, both of Toyohashi; Akira Shibata, Anjo, all of Japan

[73] Assignees: Nippondenso Co., Ltd., Kariya; Nippon Soken Inc., Nishio, both of Japan

[21] Appl. No.: 420,637

[22] Filed: Apr. 12, 1995

Related U.S. Application Data

[63] Continuation of Ser. No. 79,281, Jun. 21, 1993, abandoned.

[30] Foreign Application Priority Data

Jun. 22, 1992 [JP] Japan ..... 4-163123

[51] Int. Cl.[6] ..... F04B 43/067

[52] U.S. Cl. ..... 417/387; 417/395

[58] Field of Search ..... 417/390, 214, 417/383, 384, 385, 387, 395, 413, 505

[56] References Cited

U.S. PATENT DOCUMENTS

| | | | |
|---|---|---|---|
| 2,362,822 | 11/1944 | Houser et al. | 417/387 |
| 2,578,746 | 12/1951 | Scherger et al. | 417/383 |
| 2,740,259 | 4/1956 | Westlund | 417/395 |
| 2,785,638 | 3/1957 | Moller . | |
| 2,843,044 | 7/1958 | Mashinter | 417/383 |
| 2,919,650 | 1/1960 | Wiggerman | 417/383 |
| 3,277,829 | 10/1966 | Burgert | 417/387 |
| 3,680,981 | 8/1972 | Wagner | 417/388 |
| 3,807,906 | 4/1974 | Breit | 417/383 |
| 4,093,403 | 6/1978 | Schrimpf et al. | 417/395 |
| 4,375,346 | 3/1983 | Kraus et al. | 417/395 |
| 4,406,591 | 9/1983 | Louis | 417/413 R |
| 4,430,048 | 2/1984 | Fritsch | 417/383 |
| 4,697,989 | 10/1987 | Perlov et al. | 417/474 |
| 4,741,678 | 5/1988 | Nehring | 417/395 |
| 4,828,464 | 5/1989 | Maier et al. | 417/385 |
| 4,865,528 | 9/1989 | Fritsch et al. | 417/385 |
| 4,950,134 | 8/1990 | Bailey | 417/383 |
| 5,002,471 | 3/1991 | Perlov | 417/413 R |
| 5,011,380 | 4/1991 | Kovacs | 417/413 R |
| 5,145,331 | 9/1992 | Goes et al. | 417/383 |
| 5,171,301 | 12/1992 | Vanderveen | 604/153 |
| 5,186,615 | 2/1993 | Karliner | 417/395 |
| 5,192,198 | 3/1993 | Gebauer et al. | 417/383 |
| 5,244,360 | 9/1993 | Lefebvre | 417/383 |

FOREIGN PATENT DOCUMENTS

| | | | |
|---|---|---|---|
| 0542401 | 5/1993 | European Pat. Off. | 604/153 |
| 3102032 | 8/1982 | Germany | 417/413 |
| 3535001 | 4/1987 | Germany | 417/383 |
| 243919 | 10/1990 | Japan . | |
| 243918 | 10/1990 | Japan . | |
| 5296149 | 11/1993 | Japan . | |
| 0606002 | 5/1978 | U.S.S.R. | 417/383 |

*Primary Examiner*—Peter Korytnyk
*Attorney, Agent, or Firm*—Cushman, Darby & Cushman

[57] ABSTRACT

A diaphragm-type pump includes a disk-like diaphragm made of an elastic material which is held between an upper housing and a lower housing. In this diaphragm-type pump, the diaphragm, which has a flat shape before it is mounted in the pump, is bent along a diaphragm stopper and mounted in the pump. Consequently, an urging force is constantly applied to the diaphragm in such a direction as to press it on the diaphragm stopper. The diaphragm is deformed in response to reciprocation of a plunger, and when the plunger reaches the bottom dead center and a cylinder chamber is decreased in pressure, the diaphragm is pressed on the diaphragm stopper by the urging force toward the diaphragm stopper and a feed pressure of a feed pump.

2 Claims, 6 Drawing Sheets

DIAPHRAGM-TYPE PUMP

This is a continuation of application Ser. No. 08/079,281, filed on Jun. 21, 1993, which was abandoned upon the filing hereof.

BACKGROUND OF THE INVENTION

The present invention relates to a diaphragm-type pump.

In an engine of a spark-ignition type such as an internal combustion engine, high-pressure injection of fuel into cylinders is effective for improving fuel consumption and decreasing emission. As a high-pressure fuel pump for this purpose, there is a diaphragm-type pump which pressurizes fuel such as gasoline through an elastic diaphragm instead of pressurizing fuel, which is a fluid having a low viscosity, directly by a plunger.

In such a diaphragm-type pump, a plunger slidably provided in a cylinder is reciprocated by a driving means, e.g., a cam. As a result of reciprocation of the plunger, the diaphragm is deformed, and suction and discharge of fuel is performed.

In the pump with the above-described diaphragm, the diaphragm functions by repeating its deformation. Therefore, it is a subject of study to improve durability of the diaphragm. In order to improve the durability, it is necessary to restrict a degree of deformation of the diaphragm and also to effect deformation operation of the diaphragm regularly.

In the conventional diaphragm-type pump, however, when the rotational speed of the pump is increased or when the viscosity of lubricating oil is increased, deformation operation of the diaphragm becomes irregular. Consequently, the diaphragm is deformed to a degree beyond a predetermined maximum deformation degree, or is vibrated unnecessarily. If the diaphragm is brought into such a condition, although there will be no problem in relation to suction and discharge of fuel, fatigue failure of the diaphragm will be easily induced, thereby largely deteriorating the durability.

DESCRIPTION OF RELATED ART

The inventors of the present application have proposed a diaphragm-type pump in Japanese Patent Application No. 4-96672. This Japanese patent application discloses a technical proposal of restricting or suppressing a stroke of a diaphragm so as to prevent any excess deformation of the diaphragm. In this Japanese patent application, however, there is no disclosure for positively urging the diaphragm against a convex surface. In the present invention, however, the durability of the diaphragm can be extended by a technology which is different from the "restricting or suppressing a stroke of a diaphragm".

SUMMARY OF THE INVENTION

Taking the above-described problem into account, a diaphragm-type pump according to the present invention has been achieved. It is an object of the invention to improve durability of a diaphragm by deforming the diaphragm regularly.

In order to attain the above object, a diaphragm-type pump according to this invention is characterized in that it comprises a cylinder including a plunger which is reciprocated by a driving source, which cylinder pressurizes a fluid filled therein by reciprocation of the plunger, a diaphragm which is deformed by a degree corresponding to a pressure of the cylinder and performs pump operation in accordance with the deformation, a diaphragm restricting member which is provided adjacent to the diaphragm and restricts a range of deformation of the diaphragm, and urging means for applying an urging force to the diaphragm in such a direction that the diaphragm is pressed against the diaphragm restricting member.

The urging means may be constituted of the diaphragm made of a magnetic material and the diaphragm restricting member made of a magnet, and the urging force received by the diaphragm may be a magnetic force produced by the magnet.

Also, the urging means may be a spring engaged with the diaphragm, and the urging force received by the diaphragm may be an elastic force produced by the spring.

With this structure, the diaphragm performs pump operation in accordance with the pressure of the cylinder, and suction and discharge of the fluid is carried out. Further, the urging force in the direction to press the diaphragm against the diaphragm restricting member is applied to the diaphragm by the urging means. In consequence, deformation operation of the diaphragm is effected regularly.

DETAILED DESCRIPTION OF THE PREFERRED EMBODIMENTS

One embodiment of the present invention will now be described with reference to FIGS. 1 and 2.

Figure 1:
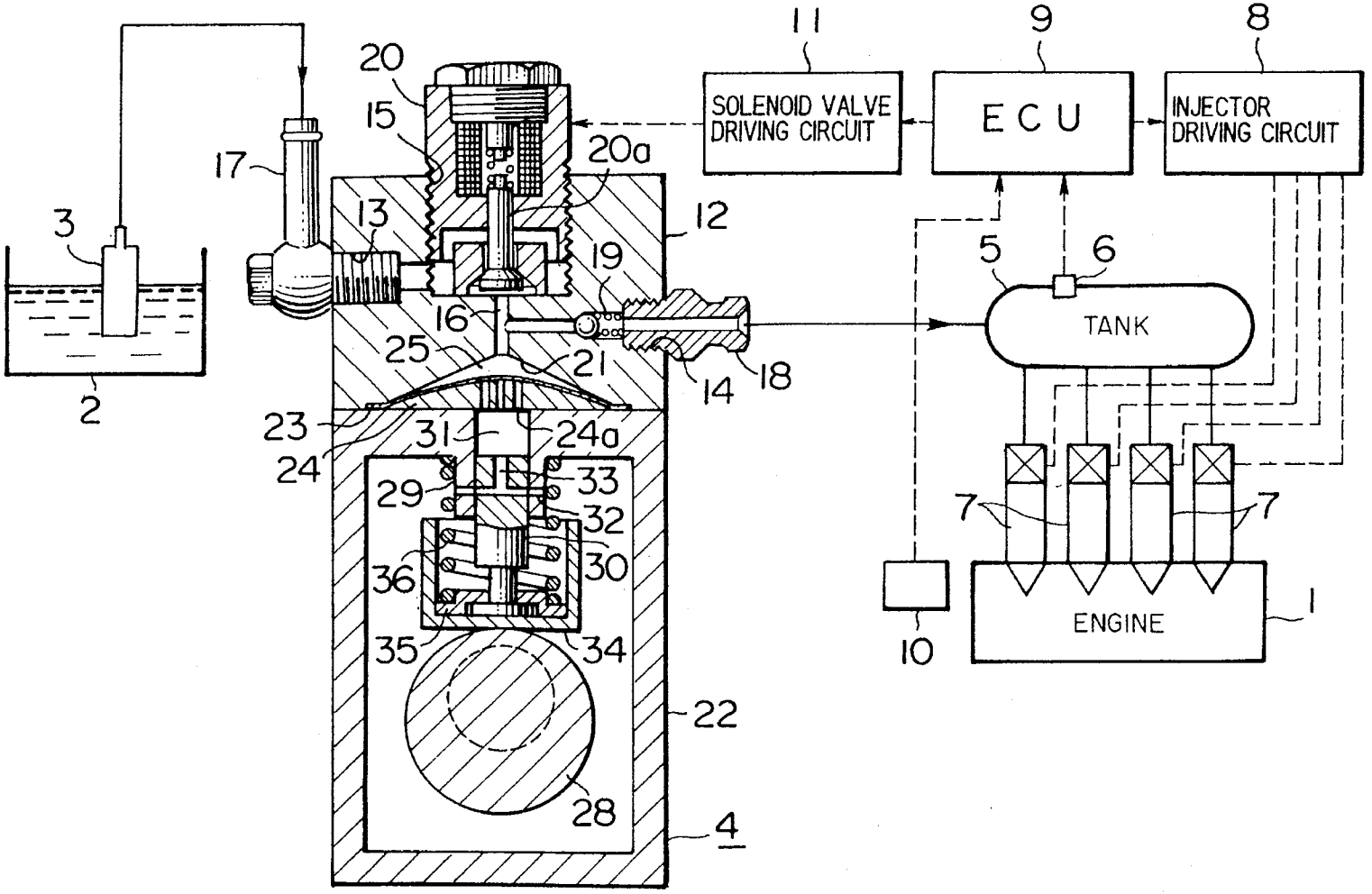
FIG. 1 is a diagram showing an entire structure of a fuel injection system of an engine and a diaphragm-type pump in detail.

FIG. 1 illustrates an entire structure of a fuel injection system of an internal combustion engine (hereinafter simply referred to as engine) 1 for a vehicle. Fuel (gasoline) in a fuel tank 2 is drawn by a feed pump 3 and supplied to a diaphragm-type pump 4. The feed pump 3 has a discharge pressure as low as about several hundred kPa.

A reserve tank 5 accumulates fuel supplied from the diaphragm-type pump 4 under a certain pressure. A pressure sensor 6 is installed on the reserve tank 5. A pressure in the reserve tank 5 is detected by this pressure sensor 6, and a pressure level signal of the detected pressure is inputted into an electronic control unit, which will be described later.

An injector 7 is provided on each air cylinder of the engine 1. The injector 7 is driven in response to an electric signal from an injector driving circuit 8. By operating the injector 7, the fuel accumulated in the reserve tank 5 is injected through the injector 7 into a combustion chamber.

A crank angle sensor 10 is installed on a crank shaft (not shown) of the engine 1, and outputs a signal for every predetermined crank angle in accordance of rotation of the engine 1.

Various kinds of engine operating signals (an engine rotational speed, an intake amount and so on) are inputted into the electronic control unit (hereinafter referred to as ECU) 9. In response to these signals, the ECU 9 determines injection timing and injection time of the injector 7 and outputs a drive signal to the injector driving circuit 8. Also, a solenoid valve driving circuit 11 for driving a solenoid valve 20, which will be described later, is connected to the ECU 9. In response to a pressure level signal from the pressure sensor 6 and a crank angle signal from the crank angle sensor 10, the ECU 9 outputs a drive signal to the solenoid valve driving circuit 11. By operating the solenoid valve 20, fuel supply from the diaphragm-type pump 4 to the reserve tank 5 is set in a certain state, and the pressure in the reserve tank 5 is kept constant.

Next, the diaphragm-type pump 4 will be described in detail.

Screw holes 13, 14 and 15 are formed in the left, right and upper surfaces of an upper housing 12, as shown in FIG. 1. The screw holes 13, 14 and 15 are communicated with one another through a communication passage 16. An inlet port 17 is provided in the screw hole 13 located on the left side of the upper housing 12, and an outlet port 18 is provided in the screw hole 14 located on the right side of the upper housing 12, with a check valve 19 interposed between the outlet port 18 and the screw hole 14. Further, the solenoid valve 20 is provided in the screw hole 15 which is located on the upper side of the upper housing 12.

The solenoid valve 20 functions in response to an output signal from the solenoid valve driving circuit 11. The solenoid valve 20 moves a valve body 20*a* in the closing direction while power is supplied, and it moves the valve body 20*a* in the opening direction while power is not supplied.

Moreover, a recess 21 of an inverted conical shape is formed in the lower surface of the upper housing 12, and a central portion of the recess 21 is communicated with the communication passage 16.

A lower housing 22 is securely fixed on a lower portion of the upper housing 12, as shown in FIG. 1. A diaphragm stopper 24 of a conical shape serving as a diaphragm restricting member is securely fixed between the upper housing 12 and the lower housing 22. A plurality of through holes 24*a* are formed in a central portion of the diaphragm stopper 24.

A disk-like diaphragm 23 made of an elastic material is clamped between the upper housing 12 and the lower housing 22. Although the diaphragm 23 has a flat shape before assembly, it is bent along the diaphragm stopper 24 at the time of assembly. Therefore, a resilient force to recover the flat shape, i.e., an urging force in a direction to press the diaphragm 23 against the diaphragm stopper 24, is constantly applied to the diaphragm 23. Thus, in this embodiment, the diaphragm 23 and the diaphragm stopper 24 constitute the urging means.

A fuel pressurizing chamber 25 is defined between the recess 21 of the upper housing 12 and the top surface of the diaphragm 23. In accordance with deformation of the diaphragm 23, the fuel pressurizing chamber 25 varies its internal volume, to thereby effect suction and discharge of the fuel.

A cylinder 29 is formed in the lower housing 22, and a plunger 30 is slidably inserted in the cylinder 29. In the cylinder 29, lubricating oil is filled in a cylinder chamber 31 which is defined by the plunger 30 and the diaphragm stopper 24. Communication holes 32 and 33 for communicating the cylinder chamber 31 and the inside of the lower housing 22 are formed in the cylinder 29 and the plunger 30. These communication holes 32 and 33 communicate with each other only when the plunger 30 reaches the bottom dead center.

A tappet 34 is provided on a lower portion of the plunger 30. The tappet 34 is supported on the plunger 30 through a plunger holder 35. A spring 36 for constantly urging the plunger 30 downwardly is provided between the plunger holder 35 and the inner surface of an upper portion of the lower housing 22.

A cam shaft 28 serving as a driving means is provided in the lower housing 22. Lubricating oil for lubricating the cam shaft 28 is filled in the lower housing 22. The oil filled in the cylinder chamber 31 and the oil filled in the lower housing 22 are moved and mixed with each other through the communication holes 32 and 33. The cam shaft 28 is eccentrically rotated when rotation is applied to it from the crank shaft (not shown) of the engine 1, and the plunger 30 is reciprocated vertically, as viewed in FIG. 1, in accordance with the rotational movement of the cam shaft 28.

The operation of the diaphragm-type pump 4 having the above-described structure will now be described.

In this embodiment, operation time of the diaphragm-type pump 4 is determined by an input signal of the pressure sensor 6 inputted into the ECU 9. That is to say, only when the pressure in the reserve tank 5 detected by the pressure sensor 6 is lower than a predetermined pressure, the ECU 9 drives the solenoid valve 20, to thereby operate the diaphragm-type pump 4.

Next, fuel suction and discharge during operation of the diaphragm-type pump 4 will be explained.

First, when the plunger 30 is moved upwardly and the fuel is discharged, a power-supply signal is transmitted from the solenoid valve driving circuit 11 to the solenoid valve 20, so as to close the solenoid valve 20. At this time, the pressure in the cylinder chamber 31 is increased in accordance with the upward movement of the plunger 30, and the oil in the cylinder chamber 31 flows into a gap between the diaphragm 23 and the diaphragm stopper 24 through the through holes 24*a* of the diaphragm stopper 24. Then, the diaphragm 23 is pressed upwardly by the oil, and resisting against the resilient force to move downwardly, the diaphragm 23 is deformed upwardly. In accordance with the deformation of the diaphragm 23, the pressure in the fuel pressurizing chamber 25 is increased. Since the solenoid valve 20 is closed, the fuel in the fuel pressurizing chamber 25 is discharged to the reserve tank 5 via the check valve 19 and the outlet port 18 by a degree corresponding to a difference between inside and outside pressures of the check valve 19.

When the plunger 30 reaches the top dead center, the diaphragm is deformed to its maximum, and discharge of the fuel is completed. At this time, the solenoid valve 20 is opened by the solenoid valve driving circuit 11, and the diaphragm-type pump 4 starts fuel suction from the fuel tank 2 by lowering the plunger 30.

When the plunger 30 is moved downwardly and suction of the fuel is performed, a non-power-supply signal is transmitted from the solenoid valve driving circuit 11 to the solenoid valve 20, so as to open the solenoid valve 20. At this time, the fuel in the fuel tank 2 is drawn by the feed pump 3, and also, the downward movement of the plunger 30 causes the pressure of the oil in the cylinder chamber 31 to be negative so that the diaphragm 23 is deformed downwardly. Then, the fuel drawn from the fuel tank 2 is drawn into the fuel pressurizing chamber 25 via the inlet port 17 and the solenoid valve 20.

When the plunger 30 reaches the bottom dead center, the cylinder chamber 31 and the inside of the lower housing 22 are communicated with each other through the communication holes 32 and 33, and consequently, the pressure in the cylinder chamber 31 becomes substantially the same as the atmospheric pressure. At this time, by the resilient force of the diaphragm 23 and the feed pressure of the feed pump 3, the diaphragm 23 is urged downwardly and pressed against the diaphragm stopper 24.

As described above, in the diaphragm-type pump 4 of this embodiment, the urging force toward the diaphragm stopper 24 is constantly applied to the diaphragm 23, and when the plunger 30 reaches the bottom dead center and the cylinder chamber 31 is decreased in pressure, the diaphragm 23 is pressed and fixed on the diaphragm stopper 24 reliably, and its position is restricted. Therefore, this is different from the conventional diaphragm-type pump in that deformation of the diaphragm 23 is effected regularly, and that the maximum deformation of the diaphragm 23 is suppressed within an allowable range so that it will not be deformed excessively. Moreover, when the diaphragm 23 is pressed and fixed on the diaphragm stopper 24, it will not vibrate unnecessarily. As a result, excessive stress and unnecessary fatigue when the diaphragm 23 is deformed can be prevented, thus improving durability of the diaphragm by a large degree.

(Other Embodiments)

The present invention is not limited to the above-described embodiment, but can be realized in the following forms.

Figure 2:
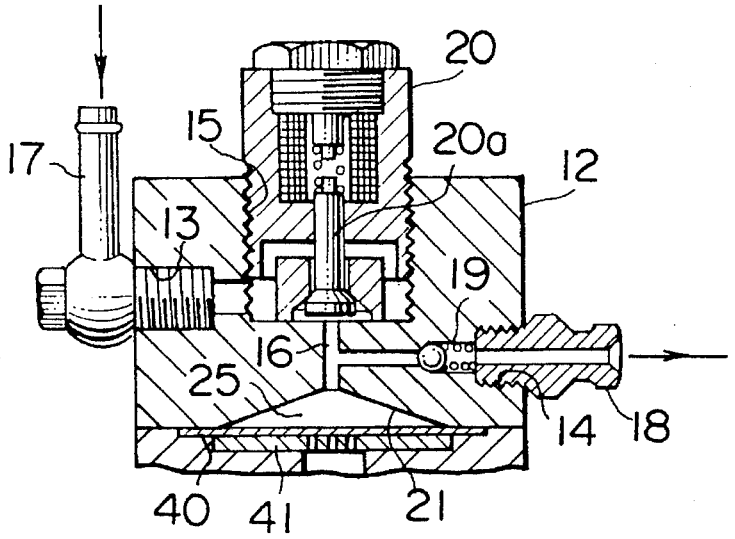
FIG. 2 is a vertical cross-sectional view showing an essential portion of another embodiment of a diaphragm-type pump.

(1) As shown in FIG. 2, a diaphragm 40 is made of a magnetic material (for example, stainless steel having magnetism), and a diaphragm stopper 41 is made of a disk-like magnet. With this structure, when a plunger 30 reaches the bottom dead center and a cylinder chamber 31 is decreased in pressure, the diaphragm 40 is pressed and fixed on the diaphragm stopper 41 by the feed pressure of the feed pump 3 and the magnetic force of the diaphragm stopper 41. In this case, the diaphragm 40 made of the magnetic material and the diaphragm stopper 41 made of the magnet constitute the urging means.

Figure 3:
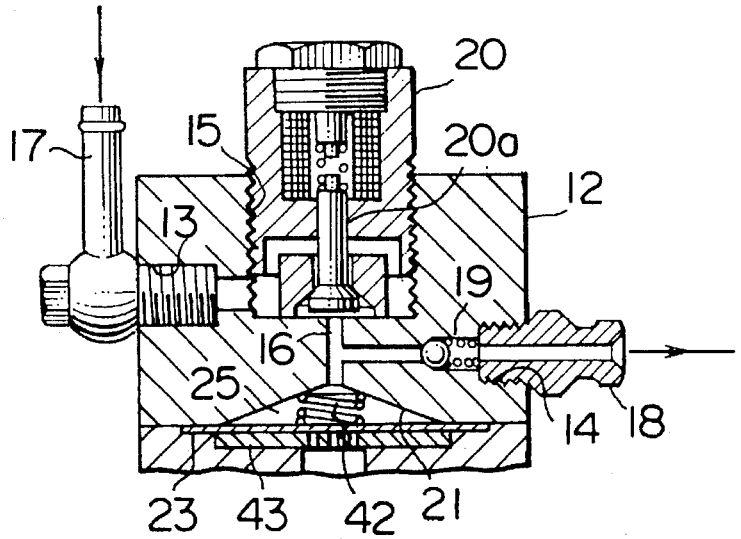
FIG. 3 is a vertical cross-sectional view showing an essential portion of a still other embodiment of a diaphragm-type pump.

(2) As shown in FIG. 3, a spring 42 is provided between a recess 21 of an upper housing 12 and a diaphragm 23. This spring 42 has an extremely small elastic force which is within such a range as not to interfere with deformation of the diaphragm 23 in accordance with an upward movement of a plunger 30. With this structure, when the plunger 30 reaches the bottom dead center and a cylinder chamber 31 is decreased in pressure, the diaphragm 23 is pressed and fixed on a diaphragm stopper 43 by the feed pressure of the feed pump 3 and the elastic force of the spring 42. In this case, the spring 42 constitutes the urging means.

(3) A diaphragm 23 is heated and expanded, and in this state, the diaphragm 23 is assembled with a diaphragm-type pump 4. In the case where the diaphragm 23 is assembled in this manner, when the heated and expanded diaphragm is cooled down, a contracting force is generated in the diaphragm 23, and the diaphragm 23 is pressed and fixed on a diaphragm stopper 24 by this contracting force. In this case, the diaphragm 23 and the diaphragm stopper 24 constitute the urging means.

Figure 4:
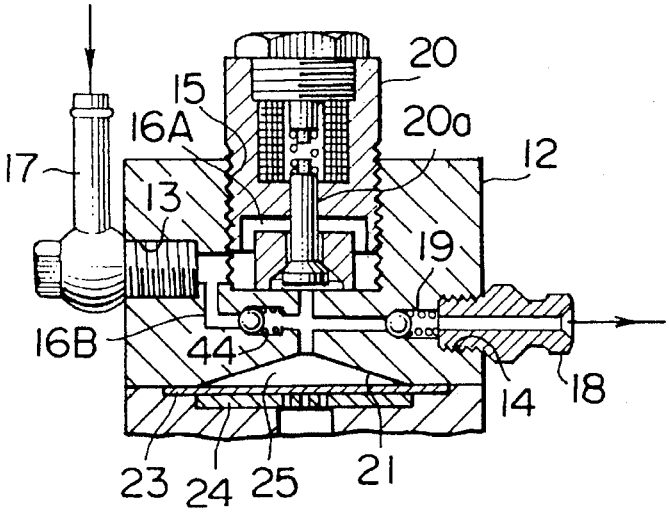
FIG. 4 is a vertical cross-sectional view showing an essential portion of a further embodiment of a diaphragm-type pump.

(4) As shown in FIG. 4, two communication passages 16A and 16B are provided on the suction side. One of the communication passages 16A is connected through by operating a solenoid valve 20, and the other communication passage 16B is connected through by opening/closing a check valve 44. The check valve 44 is designed to be open by the feed pressure of a feed pump 3 and a fuel suction pressure of a fuel pressurizing chamber 25. With this structure, it is possible to prevent the fuel feed pressure from decreasing due to throttling function of the solenoid valve 20 when the pump rotational speed is increased, and it is possible to prevent the fuel suction from stopping owing to an error in operation of the solenoid valve 20.

Figure 5:
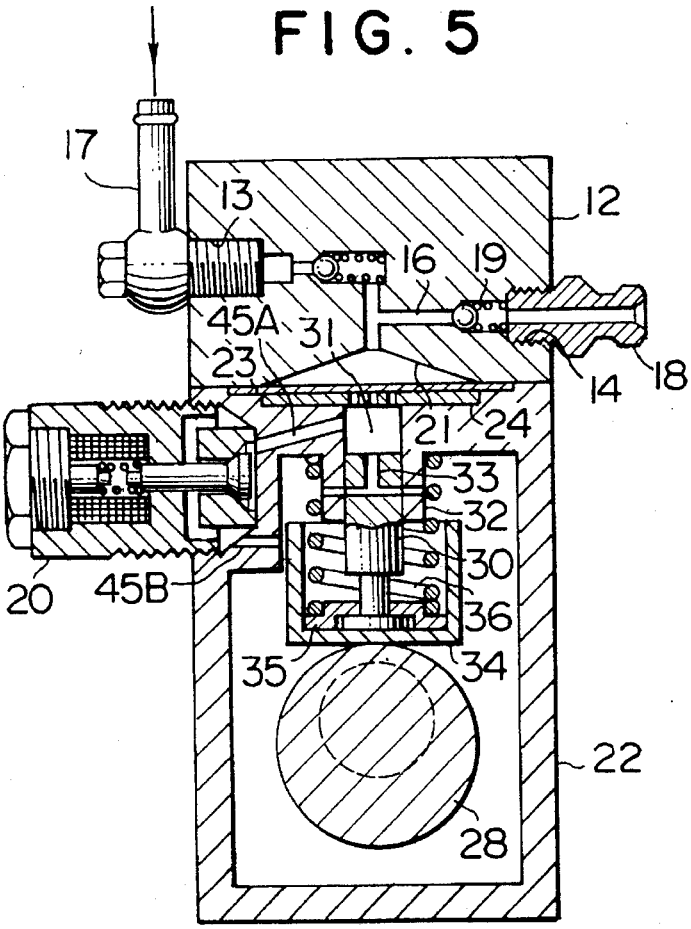
FIG. 5 is a vertical cross-sectional view showing another embodiment of a diaphragm-type pump.

(5) As shown in FIG. 5, a solenoid valve 20 is provided on the side of a lower housing 22, and one of communication passages 45A is communicated with a cylinder chamber 31 whereas the other of the communication passages 45B is communicated with the inside of the lower housing 22. When a plunger 30 is moved upwardly, the solenoid valve 20 is slightly opened, and when the plunger 30 is moved downwardly, the solenoid valve 20 is closed. With this structure, in the case where the fuel discharge amount is small, an increase of the pressure in the cylinder chamber 31 when the plunger 30 is moved upwardly can be made smaller. As a result, a deformation degree of the diaphragm 23 is decreased so that the diaphragm 23 can be attached on a diaphragm stopper 24 more closely.

Figure 6:
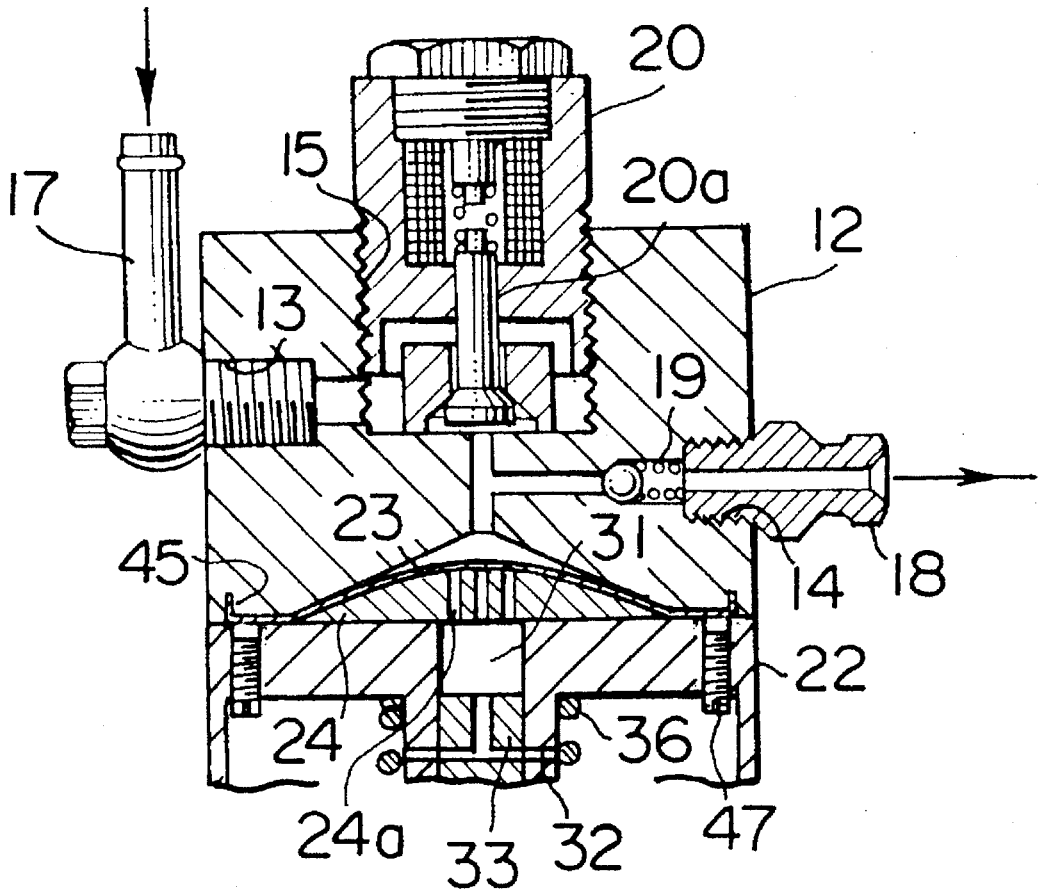
FIG. 6 is a vertical cross-sectional view showing an essential portion of a still other embodiment of a diaphragm-type pump.

(6) As shown in FIG. 6, the periphery of a diaphragm 23 is inserted in a groove 46 formed in an upper housing 12, and also, the peripheral portion of the diaphragm 23 is fastened by screw-fasteners 47. In this condition, a diaphragm stopper 24 is attached.

In this case, the peripheral portion of the diaphragm 23 is secured reliably, and the diaphragm 23 is prevented from sliding inwardly. Consequently, there is no fear of detachment of the secured diaphragm 23. Further, since the diaphragm 23 is elongated and bent with its peripheral portion being fixed, a force to restore elongation to the original state as well as a force to restore bending to the original state is constantly applied. In other words, an urging force in a direction to press the diaphragm 23 against the diaphragm stopper 24 is strengthened.

Figure 7A:
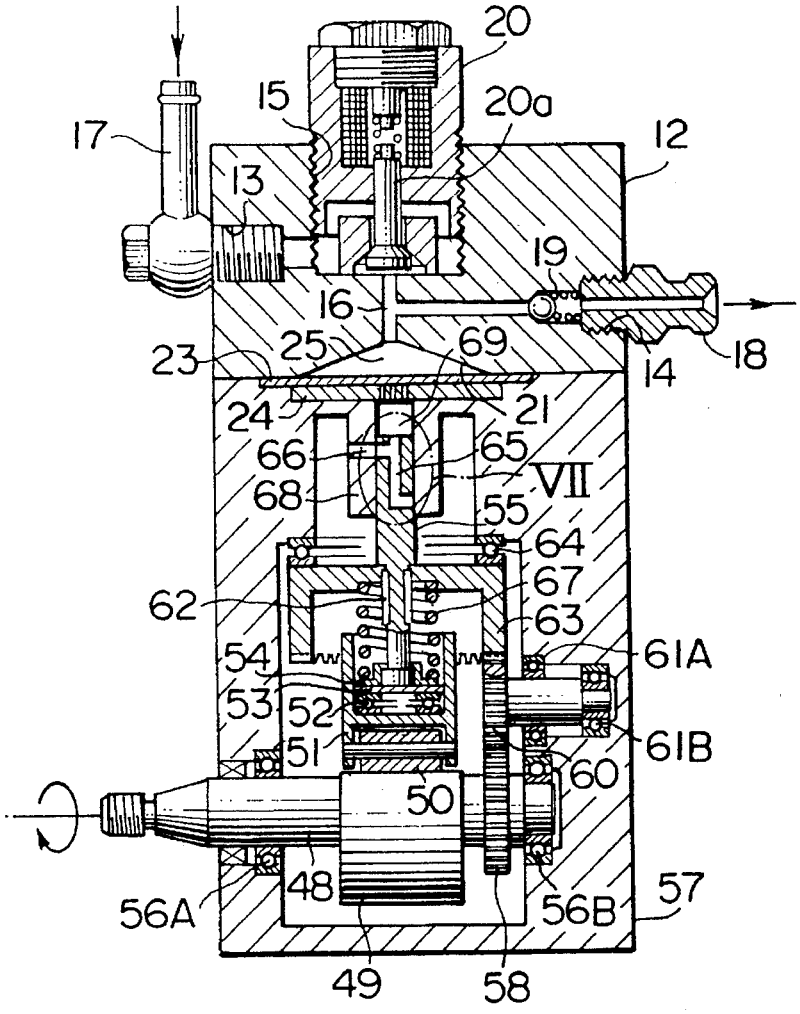
FIG. 7A is a vertical cross-sectional view showing a further embodiment of a diaphragm-type pump.

(7) As shown in FIG. 7A, a cam shaft 48 is rotatably supported by a pair of cam shaft bearings 56A and 56B. A tappet 51 is in contact with a cam 49 through a tappet bearing 50. Also, the tappet 51 is connected to a plunger 55 through a bearing 52, a tappet plate 53 and a plunger pressing member 54.

A plunger gear 63 is provided in such a manner as to surround the plunger 55 and to be rotatable on a horizontal plane, as shown in FIG. 7A, by a plunger gear bearing 64. The plunger gear 63 and the plunger 55 are integrally connected with each other by a key 62 which is press-fitted in a gap between these two members, so that the rotational movement of the plunger gear 63 will be transmitted to the plunger 55 directly. Further, by an urging force of a spring 67 interposed between the plunger gear 63 and the plunger pressing member 54, the tappet 51 is pressed on the cam 49, and consequently, the plunger 55 is moved vertically in accordance with eccentric rotation of the cam 49.

On the other hand, in a lower housing 57, a cam shaft gear 58 is provided in the vicinity of the distal end of the cam shaft 48. The cam shaft gear 58 is in mesh with a second gear 60 supported by bearings 61A and 61B. Further, the second gear 60 is in mesh with the above-mentioned plunger gear 63. Therefore, the rotational movement of the cam shaft 48 is transmitted to the plunger 55 via the cam shaft gear 58, the second gear 60 and the plunger gear 63. Incidentally, the rotational ratio of the cam shaft gear 58 and the plunger gear 63 is set at 1:1.

Figure 7B:
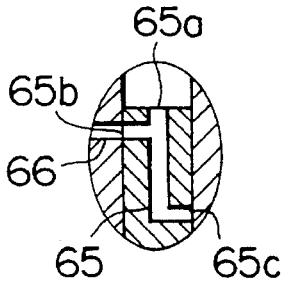
FIG. 7B is an enlarged view showing the portion VII of FIG. 7A.
Figure 8:
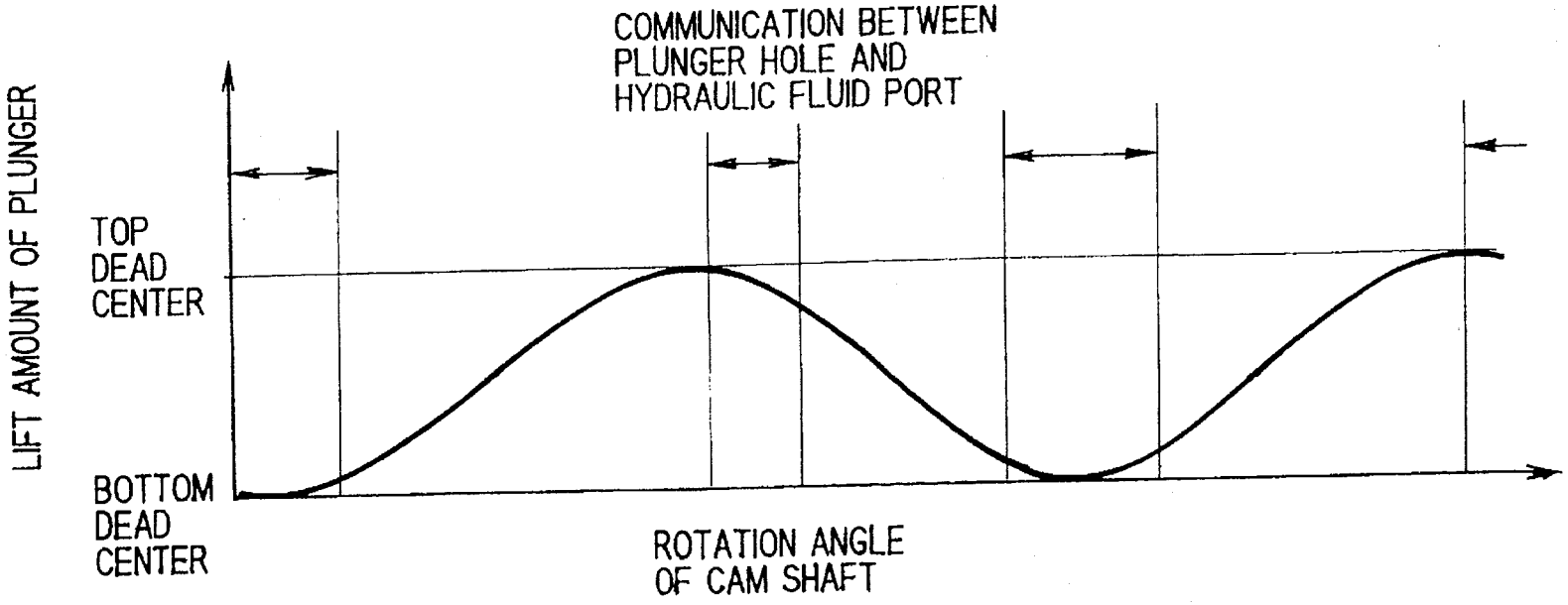
FIG. 8 is a chart illustrative of a relation between a rotation angle of a cam shaft and a lift amount of a plunger.

By the way, as specifically shown in FIG. 7B, a plunger hole 65 having three outlets 65*a*, 65*b* and 65*c* is formed in the plunger 55. Of these outlets, the outlets 65*b* and 65*c* are formed at locations which are 180° deviated from each other. Moreover, a hydraulic fluid port 66 is formed in a cylinder 68. When the cam shaft 48 is rotated and the plunger 55 accordingly reaches the top dead center, the outlet 65*c* of the plunger hole 65 is connected with the hydraulic fluid port 66, and when the plunger 55 reaches the bottom dead center and is rotated for 180°, the outlet 65*b* of the plunger hole 65 is connected with the hydraulic fluid port 66 (see FIG. 8).

With the above-described structure, in the diaphragm-type pump of this embodiment, when the plunger 55 reaches the bottom dead center, a cylinder chamber 69 and the inside of the lower housing 57 are communicated with each other through the outlet 65*b* of the plunger hole 65. At this time, the hydraulic pressure on the lower side of a diaphragm 23 becomes equal to the atmospheric pressure, and the diaphragm 23 is displaced downwardly and contacted with a diaphragm stopper 24.

Then, when the cam shaft 48 is rotated, communication between the plunger hole 65 and the hydraulic fluid port 66 is shut off by the rotational and upward movement of the plunger 55. In consequence, the hydraulic pressure on the lower side of the diaphragm 23 is increased, and the diaphragm 23 is displaced upwardly, so that fuel in a fuel pressurizing chamber 25 will be discharged from an outlet port 18.

Subsequently, when the plunger 55 reaches the top dead center, the cylinder chamber 69 and the inside of the lower housing 57 are communicated with each other through the outlet 65*c* of the plunger hole 65. Then, the hydraulic pressure on the lower side of the diaphragm 23 becomes equal to the atmospheric pressure again, and the diaphragm 23 is displaced downwardly and contacted with the diaphragm stopper 24.

When the cam shaft 48 is further rotated, communication between the plunger hole 65 and the hydraulic fluid port 66 is shut off by the rotational and downward movement of the plunger 55. In consequence, the hydraulic pressure on the lower side of the diaphragm 23 becomes negative, and hydraulic fluid remaining between the diaphragm 23 and the diaphragm stopper 24 is drawn out. Then, the diaphragm 23 is displaced downwardly and contacted with the diaphragm stopper 24. Thereafter, substantially the same operations are repeated.

In this embodiment, as described above, the diaphragm 23 is displaced only when the plunger 55 moves from the bottom dead center to the top dead center, i.e., when the fuel in the fuel pressurizing chamber 25 is discharged. At other times, the diaphragm 23 is maintained in contact with the diaphragm stopper 24 reliably. As a result, the displacement of the diaphragm 23 can be properly controlled, so as to prevent its breakage caused by irregular displacement.

According to the present invention, as specifically described heretofore, the urging force in the direction to press the diaphragm on the diaphragm restricting member is applied to the diaphragm by the urging means, so that the deformation operation of the diaphragm is effected regularly. Thus, there can be obtained an excellent effect in improving durability of the diaphragm greatly.

What is claimed is:

1. A diaphragm-type pump, comprising:

a housing assembly, a diaphragm disposed in the housing assembly, a cylinder defined in a portion of the housing assembly and adjacent the diaphragm, a plunger mounted for reciprocating movement within the cylinder between top and bottom dead center positions, a working fluid between the cylinder and the diaphragm, said working fluid being pressurized by reciprocation of the plunger, said diaphragm being displaced in accordance with a pressure of the working fluid in the cylinder to effect suction and discharge of a discharge fluid on an opposite side of the diaphragm with respect to the cylinder, thereby performing a pumping operation, a low pressure chamber in the housing assembly, wherein a pressure thereof is substantially equal to atmospheric pressure, a stopper disposed adjacent the diaphragm and being in contact therewith when the diaphragm is in a relaxed condition, and a passage structure providing fluid communication between the cylinder and the low pressure chamber at the top and bottom dead center positions of the reciprocating plunger, said passage structure being constructed and arranged such that the working fluid in the cylinder is prevented from communicating with the low pressure chamber during the reciprocation of the plunger between the top and bottom dead center positions and, at the top dead center position of the plunger, the cylinder communicates with the low pressure chamber causing the working fluid in the cylinder to be at atmospheric pressure thereby allowing the diaphragm to contact the stopper.

2. The pump according to claim 1, wherein the passage structure comprises a first passage portion formed in the cylinder and a second passage portion formed through the plunger, said second passage portion connecting the working fluid in the cylinder with the first passage portion at the top and bottom dead center positions of the reciprocating plunger.

* * * * *